US011620931B2

(12) United States Patent
Lai et al.

(10) Patent No.: US 11,620,931 B2
(45) Date of Patent: Apr. 4, 2023

(54) INVERTER AND DRIVING METHOD THEREOF, DRIVING CIRCUIT AND DISPLAY PANEL

(71) Applicant: Xiamen Tianma Micro-Electronics Co., Ltd., Xiamen (CN)

(72) Inventors: Qingjun Lai, Xiamen (CN); Yihua Zhu, Xiamen (CN); Yong Yuan, Shanghai (CN); Ping An, Shanghai (CN); Zhaokeng Cao, Shanghai (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 17/644,627

(22) Filed: Dec. 16, 2021

(65) Prior Publication Data

US 2022/0254292 A1 Aug. 11, 2022

(30) Foreign Application Priority Data

Feb. 5, 2021 (CN) ..... 202110163571.7

(51) Int. Cl.
*G09G 3/20* (2006.01)

(52) U.S. Cl.
CPC ..... *G09G 3/20* (2013.01); *G09G 2320/0209* (2013.01); *G09G 2320/0247* (2013.01)

(58) Field of Classification Search
CPC ..... G09G 3/20; G09G 2320/0209; G09G 220/0247
See application file for complete search history.

(56) References Cited

U.S. PATENT DOCUMENTS

2017/0213490 A1* 7/2017 Jeong ..... G09G 3/20
2017/0213495 A1* 7/2017 Lee ..... G09G 3/3688
2020/0125314 A1* 4/2020 Cho ..... G02F 1/136204
2020/0126479 A1* 4/2020 Yamasaki ..... G09G 3/3225

FOREIGN PATENT DOCUMENTS

CN 103632633 B 8/2016

* cited by examiner

*Primary Examiner* — Sejoon Ahn
(74) *Attorney, Agent, or Firm* — Anova Law Group PLLC

(57) ABSTRACT

An inverter, a method for driving an inverter, a driving circuit and a display panel are provided. An inverter includes a first module; a second module; an initial signal input terminal; and a first level signal input terminal. The first module includes a first transistor, a second transistor, and a third transistor; control terminals of the first transistor and the second transistor are both electrically connected to the initial signal input terminal; a first terminal of the third transistor is electrically connected to the first level signal input terminal; a first terminal of the second transistor is electrically connected to a first terminal of the second transistor; a second terminal of the second transistor is electrically connected to a control terminal of the third transistor; the first module includes a leakage current control component at least electrically connected with the second terminal of the first transistor.

15 Claims, 7 Drawing Sheets

INVERTER AND DRIVING METHOD THEREOF, DRIVING CIRCUIT AND DISPLAY PANEL

CROSS-REFERENCE TO RELATED APPLICATION

This application claims the priority of Chinese Patent Application No. 202110163571.7, filed on Feb. 5, 2021, the content of which is incorporated by reference in its entirety.

TECHNICAL FIELD

The present disclosure generally relates to the field of display technology and, more particularly, relates to an inverter and a driving method of an inverter, a driving circuit and a display panel.

BACKGROUND

With the continuous development of the display technologies, the power consumption of the display device has also increased while pursuing a higher resolution of the display device. To reduce the power consumption of the display device, the pixels can be driven at a low speed by reducing the frame rate within a certain time. For example, for a display device, a normal drive frequency based on 60 Hz, 90 Hz, or 120 Hz is performed in the normal display mode; and a drive frequency based on 1 Hz-50 Hz is performed in the standby mode, thereby reducing the power consumption of the display panel.

In the existing technologies, positive channel metal oxide semiconductor (PMOS) designs are mostly used in inverters. However, due to the large leakage current of the PMOS formed by using the low temperature poly-silicon (LTPS) material, the data update cycle is longer when driving at a low frame rate. When there is a leakage current in the inverter circuit, the inverter may be unable to output a stable control signal, causing the corresponding display product to have the problem of display flickering, and the display effect is adversely affected.

Therefore, there is need to improve the inverter and the display effect of the display panels. The disclosed inverters, driving methods of the inverters, driving circuits and display panels are directed to solve one or more problems set forth above and other problems in the art.

SUMMARY

One aspect of the present disclosure provides an inverter. The inverter may include a first module; a second module; an initial signal input terminal; and a first level signal input terminal. The first module may include a first transistor, a second transistor, and a third transistor. A control terminal of the first transistor and a control terminal of the second transistor may be both electrically connected to the initial signal input terminal; a first terminal of the third transistor may be electrically connected to the first level signal input terminal; a first terminal of the second transistor may be electrically connected to a first terminal of the second transistor; a second terminal of the second transistor may be electrically connected to a control terminal of the third transistor through a first node. The first module may include a leakage current control component; and the leakage current control component may be at least electrically connected with the second terminal of the first transistor.

Another aspect of the present disclosure provides a method for driving an inverter. The inverter may include a first transistor, a second transistor, a third transistor, a fifth transistor, a sixth transistor, a seventh transistor, an eighth transistor, a ninth transistor, a leakage current control component, an initial signal input terminal, a first level signal input terminal, a first clock signal input terminal, a third level signal input terminal, a signal output terminal, a first node, a second node and a third node. The method may include inputting a second type of level signal at the initial signal input terminal to turn on for conductions of the first transistor and the second transistor. The first node may receive a first type of the level signal input from the leakage current control component. The method may also include inputting the second type of level signal at the third level signal input terminal to turn on for a conduction of the sixth transistor. The first type of level signal may be charged into the second node, the third transistor and the ninth transistor may be both turned off for disconnections, the seventh transistor may be turned on for a conduction, the second type of level signal may be charged into the third node, the eighth transistor may be turned on for a conduction, and the signal output terminal may output the first type of level signal. The method also may include inputting the first type of level signal at the initial signal input terminal to turn off for disconnections of the first transistor and the second transistor. The first clock signal input terminal may input the second type of level signal, and the fifth transistor may be turned on for a conduction. The method may also include inputting the first type of level signal at the first level signal input terminal. The third node may receive the first type of level signal, the eighth transistor may be turned off for a disconnection. Further, the method may include inputting the second type of level signal at the third level signal input terminal to turn on for a conduction of the sixth transistor. The second type of level signal may be charged into the second node, the ninth transistor may be turned on for a conduction, and the signal output terminal may output the second type of level signal.

Another aspect of the present disclosure provides a driving circuit. The driving circuit may include a disclosed inverter.

Another aspect of the present disclosure provides a display panel. The display panel may include a disclosed driving circuit.

Other aspects of the present disclosure can be understood by those skilled in the art in light of the description, the claims, and the drawings of the present disclosure.

BRIEF DESCRIPTION OF THE DRAWINGS

To explain the embodiments of the present disclosure or the technical solutions in the prior art more clearly, the following will briefly introduce the drawings that need to be used in the description of the embodiments or the prior art. Obviously, the drawings in the following description are only embodiments of the present disclosure. For those of ordinary skill in the art, other drawings can be obtained according to the provided drawings without creative work. The following drawings are merely examples for illustrative purposes according to various disclosed embodiments and are not intended to limit the scope of the present disclosure.

DETAILED DESCRIPTION

Figure 1:
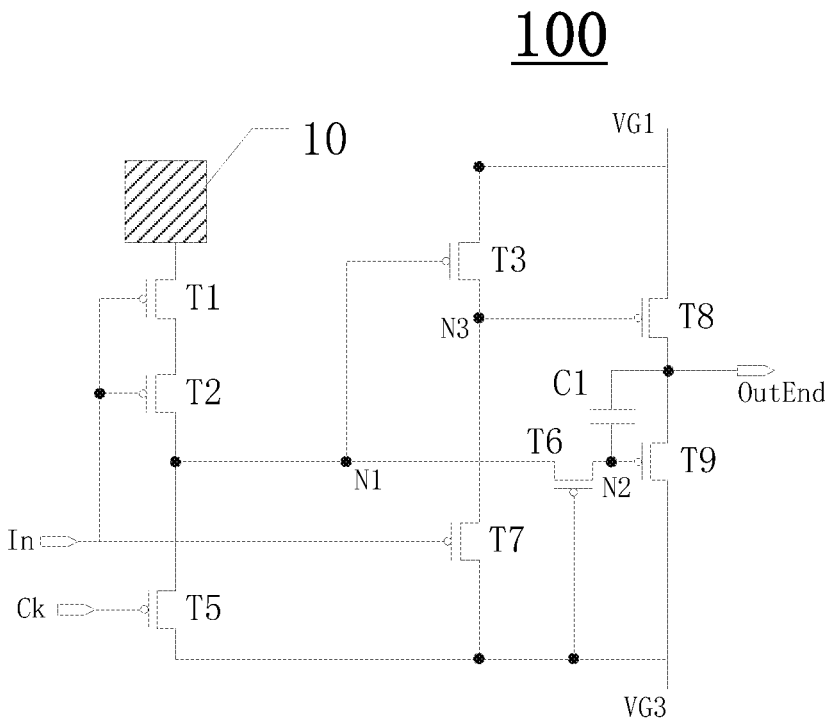
FIG. 1 illustrates a partial circuit diagram of an inverter.

Various exemplary embodiments of the present disclosure will now be described in detail with reference to the accompanying drawings. It should be noted that unless specifically stated otherwise, the relative arrangement of components and steps, numerical expressions and numerical values set forth in these embodiments do not limit the scope of the present disclosure.

The following description of at least one exemplary embodiment is actually only illustrative, and in no way serves as any limitation to the present disclosure and its application or use.

The technologies, methods, and equipment known to those of ordinary skill in the relevant fields may not be discussed in detail, but where appropriate, the technologies, methods, and equipment should be regarded as part of the specification.

In all examples shown and discussed herein, any specific value should be interpreted as merely exemplary, rather than as a limitation. Therefore, other examples of the exemplary embodiment may have different values.

It should be noted that similar reference numerals and letters indicate similar items in the following drawings, so once an item is defined in one drawing, it does not need to be further discussed in the subsequent drawings.

Figure 2:
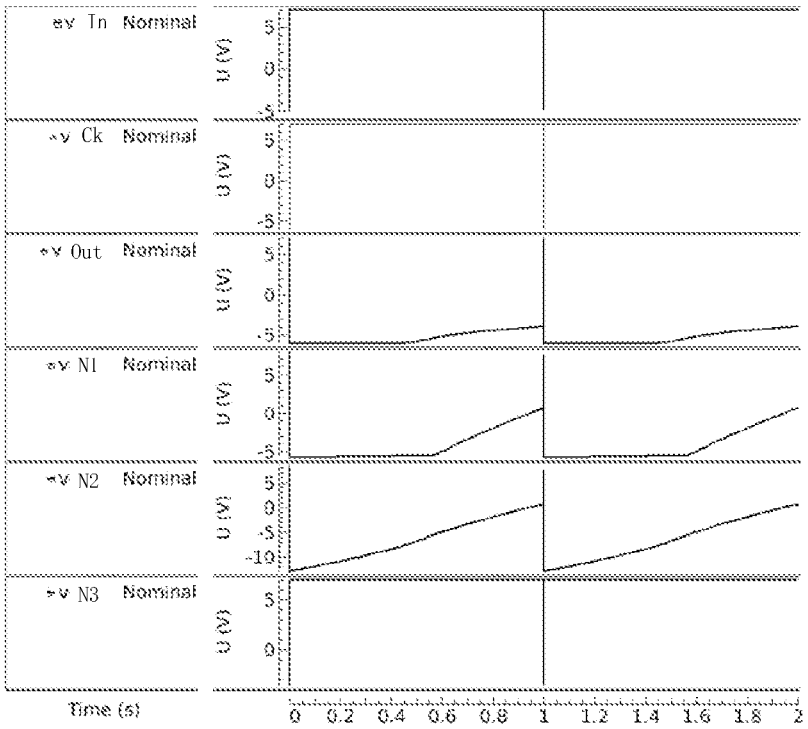
FIG. 2 illustrates terminal signals of the corresponding inverter in FIG. 1.

FIG. 1 shows a partial circuit diagram of an inverter. The inverter is a PMOS design inverter. As shown in FIG. 1, in the low-frequency display stage, when the threshold voltage (Vth) of the first transistor M1 and the second transistor M2 in the inverter circuit increases, there will be a large leakage current passing through the first transistor M1 and the second transistor M2, resulting in the increase of the potential of the first node N1 and the second node N2. When the potential of the second node N2 is higher than the voltage of VG3, the turning-on of the ninth transistor M8 will be affected. The ninth transistor M8 is turned off, and the leakage current of the eighth transistor M7 will cause the output voltage Vout to be raised, which in turn causes the brightness of the pixels driven by the output voltage Vout to change, and the corresponding display device may appear to flicker. FIG. 2 shows a schematic diagram of the signals at each terminal of the inverter corresponding to FIG. 1. FIG. 2 clearly shows that when the potential of the first node N1 and the second node N2 is raised due to the leakage current, the corresponding output voltage Vout obviously has the problem of a low-potential upturn. The increase of the output voltage Vout will cause the pixel brightness to change, and the display device will flicker.

The present disclosure provides an inverter, a driving method of an inverter, a driving circuit, and a display panel, which may be used to reduce the problem of the display flicker in the display device.

Figure 3:
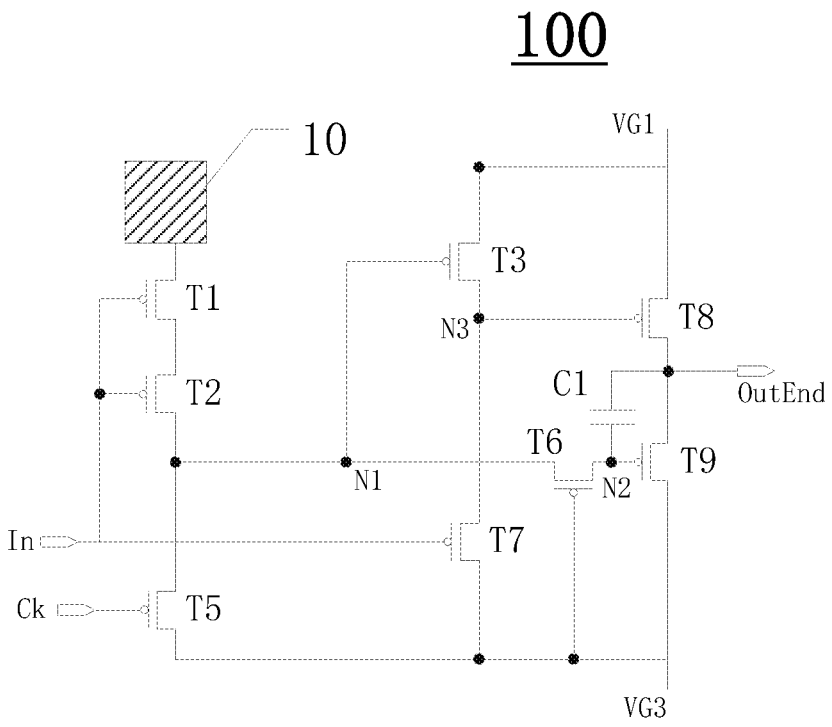
FIG. 3 illustrates a partial circuit diagram of an exemplary inverter consistent with various disclosed embodiments of the present disclosure.

FIG. 3 is a schematic diagram of a partial circuit diagram of an exemplary inverter consistent with various disclosed embodiments of the present disclosure. As shown in FIG. 3, the inverter 100 may include a first module and a second module.

The first module may include a first transistor T1, a second transistor T2, and a third transistor T3. The control terminal of the first transistor T1 and the control terminal of the second transistor T2 may all be electrically connected to an initial signal input terminal In. The first terminal of the third transistor T3 may be electrically connected to a first level signal input terminal VG1. The first terminal of the second transistor T2 may be electrically connected to the first terminal of the first transistor T1, and the second terminal of the second transistor T2 may be electrically connected to the control terminal of the third transistor T3 through a first node N1.

The first module may also include a leakage current control component 10. The leakage current control component 10 may at least be electrically connected to the second terminal of the first transistor T1.

For example, the present disclosure provides an inverter 100. When the inverter 100 is working, it may be necessary to avoid the problem that the potentials of the first node N1 and the second node N2 are raised. The inverter 100 may include a first module and a second module. The first module may include a first transistor T1, a second transistor T2, and a third transistor T3. Both the first transistor T1 and the second transistor T2 may be able to receive the electrical signals from the initial signal input terminal In. The electrical signal at the initial signal input terminal In may be used to control the turning on/off of the first transistor T1 and the second transistor T2. The first transistor T1 and the second transistor T2 may be simultaneously turned on or simultaneously turned off under the control of the electrical signal transmitted by the initial signal input terminal In.

The first terminal of the third transistor T3 may be electrically connected to the first level signal input terminal VG1, and may be used to receive the electric signal from the first level signal input terminal VG1. The second transistor T2 and the first transistor T1 may be electrically connected. For example, the first terminal of the second transistor T2 may be electrically connected to the first terminal of the first transistor T1. The second terminal of the second transistor T2 may be electrically connected to the control terminal of the third transistor T3 through the first node N1. Because the first transistor T1 and the second transistor T2 may be electrically connected, when the first transistor T1 and the second transistor T2 are turned on by the electrical signal of the initial signal input terminal In, the electrical signal received by the second terminal of the first transistor T1 may be transmitted to the first node N1 through the first transistor T1 and the second transistor T2. The control terminal of the third transistor T3 may be turned on or off by the electrical signal of the first node N1. For example, the electrical signal received by the second terminal of the first transistor T1 may be stored in the first node N1, and the electrical signal stored in the first node N1 may be used to control the on/off of the third transistor T3.

The inverter 100 provided in the present disclosure may further include a leakage current control component 10, and the leakage current control component 10 may be disposed in the first module. For example, one terminal of the leakage current control component 10 may be electrically connected to the second terminal of the first transistor T1. When the first transistor T1 and the second transistor T2 are at the off state, the leakage current control component 10 may be used to suppress the leakage current transmitted to the first node N1 through the first transistor T1 and the second transistor T2 such that, when the first transistor T1 and the second transistor T2 are at the off state, the first node N1 may have a stable electric potential to prevent the electric potential of the first node N1 from rising due to the leakage current input. Accordingly, the electrical signal output to the pixel unit through the inverter 100 may be controlled to have a substantially stable potential such that the pixel unit driven by the inverter 100 may not have the problem of brightness change, and the phenomenon of flickering in the display device may be avoided.

The present disclosure does not limit the specific structure of the leakage current control component 10, as long as it can ensure that the first node N1 may have a stable potential when the first transistor T1 and the second transistor T2 are at the off state.

Figure 4:
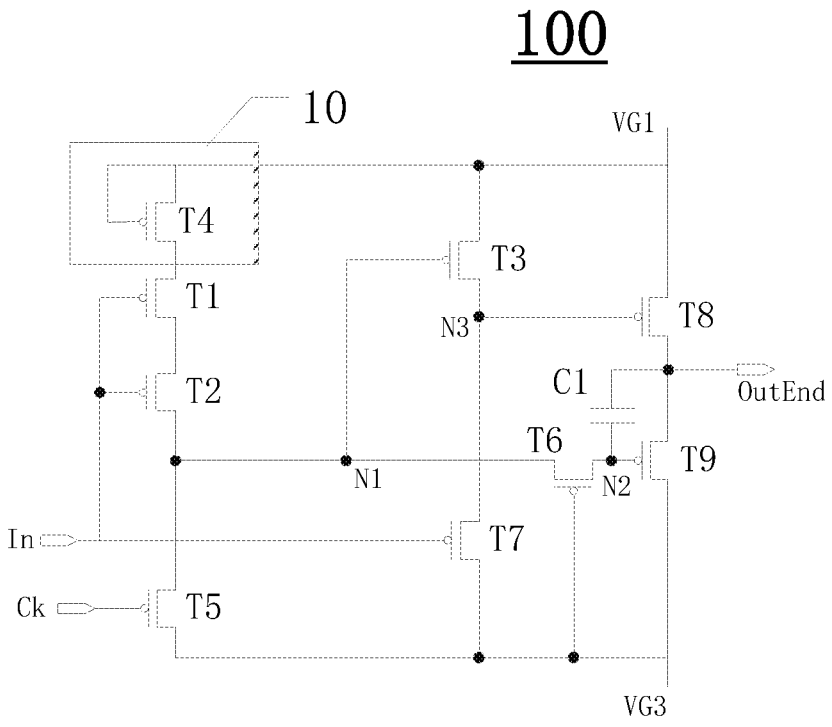
FIG. 4 illustrates another partial circuit diagram of an exemplary inverter consistent with various disclosed embodiments of the present disclosure.

FIG. 4 is a schematic diagram of another partial circuit diagram of an exemplary inverter consistent with various disclosed embodiments. As shown in FIG. 4, in one embodiment, the leakage current control component 10 may include a fourth transistor T4, and the control terminal of the fourth transistor T4 may be electrically connected to the first terminal of the fourth transistor T4. The first terminal of the fourth transistor T4 may be electrically connected to the first level signal input terminal VG1, and the second terminal of the fourth transistor T4 may be electrically connected to the second terminal of the first transistor T1.

For example, the present disclosure may provide a specific structure of a leakage current control component 10. The leakage current control component 10 may include a fourth transistor T4. The fourth transistor T4 may be an indium gallium zinc oxide thin-film transistor (IGZO TFT). The control terminal of the fourth transistor T4 may be electrically connected to its first terminal. The second terminal may be electrically connected to the second terminal of the first transistor T1, and the first terminal of the fourth transistor T4 may be electrically connected to the first level signal input terminal VG1. In other words, the control terminal and the first terminal of the fourth transistor T4 may both be electrically connected to the first level signal input terminal VG1, and may be both able to receive the electrical signal transmitted by the first level signal input terminal VG1.

Because the fourth transistor T4 may be an indium gallium zinc oxide thin-film transistor, and the IGZO TFT may have the characteristics of low cost and low leakage current, when the fourth transistor T4 with the characteristics of the low leakage current is provided in the inverter 100, the overall leakage current in the inverter 100 may be reduced. For example, the leakage current flowing through the first transistor T1 and the second transistor T2 may be reduced, and the leakage current transmitted to the first node N1 may be avoided. Accordingly, the potential rise of the first node of N1 may be avoided, the electrical signal output to the pixel unit through the inverter 100 may have a stable potential. Thus, the pixel unit driven by the inverter 100 may not have the problem of brightness changes, and the flickering issue in the display products may be avoided.

Figure 5:
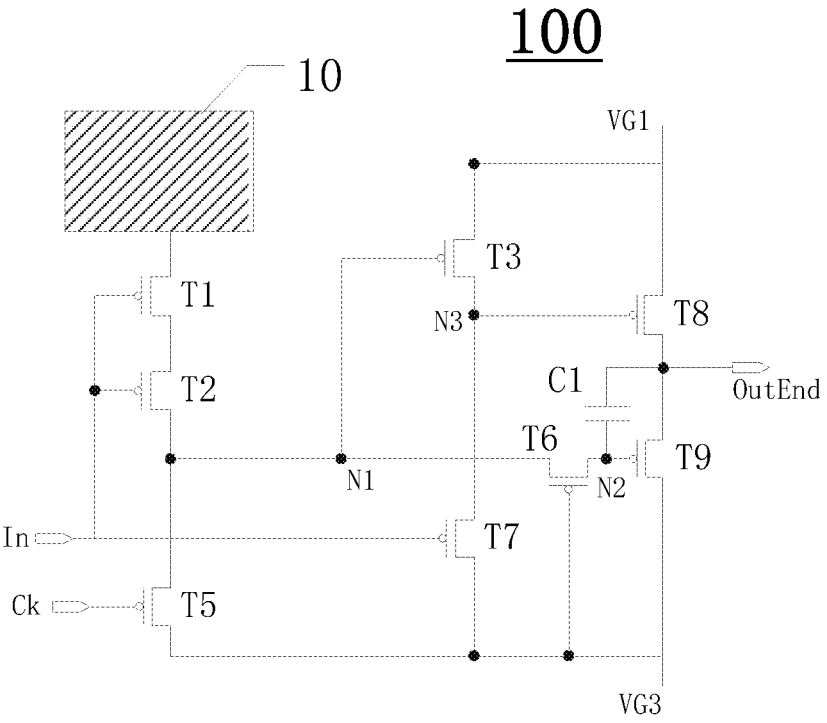
FIG. 5 illustrates another partial circuit diagram of an exemplary inverter consistent with various disclosed embodiments of the present disclosure.

FIG. 5 is a schematic diagram of another partial circuit diagram of another exemplary inverter consistent with various disclosed embodiments of the present disclosure. As shown in FIG. 5, in one embodiment, the leakage current control component 10 may include a second level signal input terminal VG2. The second level signal input terminal VG2 may be electrically connected to the second terminal of the first transistor T1.

For example, in addition to the leakage current control component 10 including the fourth transistor T4 shown in FIG. 4, the present disclosure also provides another specific structure of the leakage current control component 10. As shown in FIG. 5, the leakage current control component 10 may include anther signal input terminal, specifically the second level signal input terminal VG2; and the second level signal input terminal VG2 may be electrically connected to the second terminal of the first transistor T1. The second level signal input terminal VG2 may be configured to control the value of the leakage current of the first node N1 transmitted by the first transistor T1 and the second transistor T2 to the first transistor T1 using the difference between the voltage signal transmitted to the inverter 100 by the second level signal input terminal VG2 and the voltage signal transmitted to the inverter 100 by the initial start signal input terminal In.

Based on such a configuration, the second level signal input terminal VG2 provided in the present disclosure may replace the electrical signal of the first level signal input terminal VG1. That is, the second terminal of the first transistor T1 may only be connected to the second level signal input terminal VG2, and may not have an electrical connection relationship with the first level signal input terminal VG1. In the present disclosure, by controlling the values of the electrical signal transmitted from the second level signal input terminal VG2 to the first transistor T1 and the second transistor T2, the ability of the first transistor T1 and the second transistor T2 to transmit the leakage current to the first node N1 and the second node N2 may be controlled. Thus, the leakage current received by the first node N1 and the second node N2 may be reduced and the potential rise of the second node N2 and the first node N1 caused by the leakage current may be avoided. Accordingly, the potential of the first node N1 and the second node N2 may be in a stable state.

It should be noted that, according to the aforementioned features of the present disclosure, when the additional second level signal input terminal VG2 inputs electrical signals to the first transistor T1 and the second transistor T2, the electrical signal needs to be able to reduce the leakage current passing through the first transistor T1 and the second transistor T2 to avoid the potential rise of the first node N1.

In the present disclosure, the details how to set the characteristics of the electrical signal of the second level signal input terminal VG2 to avoid the situation that the potential of the first node N1 rises may be referred to the subsequent description.

Further, referring to FIGS. 3-5, in one embodiment, the first transistor T1, the second transistor T2 and the third transistor T3 may all be P-type transistors. The first level signal input terminal VG1 may input a first level signal, and the second level signal input terminal VG2 may input a second level signal. The first level signal and the second level signal may be both a constant first type of level signal.

For example, in the present disclosure, the first transistor T1, the second transistor T2 and the third transistor T3 may all P-type transistors, and the signal transmitted to the inverter 100 by the first signal input terminal VG1 may be the first level signal and the signal transmitted to the inverter 100 by the second level signal input terminal VG2 may be a second level signal. Here, the first-level signal and the second-level signal may be both constant first type of level signals. When the first transistor T1, the second transistor T2 and the third transistor T3 are all P-type transistors, and the first type of level signal may be specifically a high-level signal.

When the leakage current control component 10 is the fourth transistor T4, in the case where the first transistor T1, the second transistor T2 and the third transistor T3 are all P-type transistors, in one embodiment, the fourth transistor T4 may also be selected from a P-type transistor. P-type transistors may have a higher stability, which may ensure that the transmission of electrical signals in the inverter 100 may be more stable.

Referring to FIG. 3 to FIG. 5, in one embodiment, the second level signal is smaller than the first level signal.

Specifically, it is specifically explained here how to set the characteristics of the electrical signal of the second level signal input terminal VG2 to avoid the situation that the potential of the first node N1 rises. When the leakage control component 10 is the second level signal input terminal VG2, under the premise that the first level signal and the second level signal are both high-level signals, the second level signal may be set to be smaller than the first level signal. For example, when the high-level signal transmitted to the inverter 100 by the second level signal input terminal VG2 may be V1, and the high-level signal transmitted to the inverter 100 by the first level signal input terminal VG1 may be V2, V1>V2. Under such a configuration, even if the threshold voltage Vth of the first transistor T1 and the second transistor T2 increases during operation, by pulling down the potential of the driving signal transmitted to the first transistor T1 and the second transistor T2, the first transistor T1 and the second transistor T2 may be turned off and may be completely turned off. Accordingly, the leakage current transmitted to the first node N1 and the second node N2 by the first transistor T1 and the second transistor T2 may be reduced, and the potential rise at the first node N1 and the second node N2 may be avoided. Thus, the potentials of the first node N1 and the second node N2 may be both at a stable state. Under such a configuration, the electrical signal output to the pixel unit through the inverter 100 may have a stable potential. Thus, the pixel unit driven by the inverter 100 may not have the problem of brightness changes, and the flickering phenomenon of the display device may be avoided.

Further, referring to FIGS. 3-5, in one embodiment, the second module may include a fifth transistor T5, a sixth transistor T6, a seventh transistor T7, an eighth transistor T8, a ninth transistor T9 and a first capacitor C1. The second module may also a clock signal input terminal Ck, a third level signal input terminal VG3, and a signal output terminal OutEnd.

The control terminal of the fifth transistor T5 may be electrically connected to the first clock signal input terminal Ck, the first terminal may be electrically connected to the first node N1, and the second terminal may be electrically connected to the third level signal input terminal VG3.

The control terminal of the sixth transistor T6 may be electrically connected to the third level signal input terminal VG3, the first terminal may be electrically connected to the first node N1, and the second terminal may be electrically connected to the control terminal of the ninth transistor T9 through the second node N2.

The control terminal of the seventh transistor T7 may be electrically connected to the initial signal input terminal In, the first terminal may be electrically connected to the second terminal of the third transistor T3 through the third node N3, and the second terminal may be electrically connected to the third level signal input terminal VG3.

The control terminal of the eighth transistor T8 may be electrically connected to the third node N3, the first terminal may be electrically connected to the first level signal input terminal VG1, and the second terminal may be electrically connected to the signal output terminal OutEnd.

The first terminal of the ninth transistor T9 may be electrically connected to the signal output end OutEnd, and the second terminal may be electrically connected to the third level signal input terminal VG3.

The first plate of the first capacitor C1 may be electrically connected to the second node N2, and the second plate may be electrically connected to the signal output terminal OutEnd.

For example, the inverter 100 provided by the present disclosure may also include a second module in addition to the first module. The second module may include the fifth transistor T5, the sixth transistor T6, the seventh transistor T7, the eighth transistor T8, the ninth transistor T9 and the first capacitor C1. The second module may also include the first clock signal input terminal Ck, the third level signal input terminal VG3 and the signal output terminal OutEnd.

Based on the foregoing electrical connection relationship between the components in the first module, the electrical connection relationship between the components in the second module is specifically described here as following. The control terminal of the fifth transistor T5 may be electrically connected with the first clock signal input terminal. The first clock signal input terminal Ck may be configured to transmit an electrical signal to the fifth transistor T5 to control the fifth transistor T5 to be at an on or off state. The first terminal of the fifth transistor T5 may be electrically connected to the first node N1. The second terminal of the fifth transistor T5 may be electrically connected to the third level signal input terminal VG3, and the third level signal input terminal VG3 may transmit an electrical signal to the first node N1 through the fifth transistor T5.

The first terminal of the sixth transistor T6 may be electrically connected to the first node N1, the second terminal of the sixth transistor T6 may be electrically connected to the control terminal of the ninth transistor T9 through the second node N2 and the control terminal of the sixth transistor T6 may be electrically connected to the third level signal input terminal VG3 for receiving the electrical signal transmitted by the third level signal input terminal VG3, and controlling the turning on or off of the sixth transistor T6 through the electrical signal. When the sixth transistor T6 is at the on state, the pre-charged electrical signal in the first node N1 may be transmitted to the second node N2 through the sixth transistor T6, and then the ninth transistor T9 may be controlled to be turned on or off through the electrical signal stored in the second node N2.

The first terminal of the seventh transistor T7 may be electrically connected to the second terminal of the third transistor T3 through the third node N3, and the second terminal of the seventh transistor T7 may be electrically connected to the third level signal input terminal VG3. The control terminal of the seventh transistor T7 may be electrically connected to the initial signal input terminal In, and the electrical signal of the initial signal input terminal In may be configured to control the seventh transistor T7 to be at the on state or the off state. When the seventh transistor T7 is at the on state, the third level signal input terminal VG3 may charge the electrical signal to the third node N3 through the seventh transistor T7.

The control terminal of the eighth transistor T8 may be electrically connected to the third node N3, and the electrical signal stored in the third node N3 may be used to further control the eighth transistor T8 to be at the on state or the off state. The first terminal of the eighth transistor T8 may be electrically connected to the first level signal input terminal VG1, and the second terminal of the eighth transistor T8 may be electrically connected to the signal output terminal OutEnd. For example, when the eighth transistor T8 is at the on state, the electrical signal transmitted by the first level signal input terminal VG1 may be transmitted to the signal output terminal OutEnd through the eighth transistor T8.

The first terminal of the ninth transistor T9 may be electrically connected to the signal output terminal OutEnd, and the second terminal of the ninth transistor T9 may be electrically connected to the third level signal input terminal VG3. When the electrical signal stored in the second node N2 controls the ninth transistor T9 to be at the on state, the electrical signal transmitted by the third level signal input terminal VG3 may be transmitted to the signal output terminal OutEnd through the ninth transistor T9.

The first plate of the first capacitor C1 may be electrically connected to the second node N2, and the second plate of the first capacitor C1 may be electrically connected to the signal output terminal OutEnd. The first capacitor C1 may be configured to adjust the electrical signal of the second node N2 such that the potential of the second node N2 may be at a steady state.

In summary, the inverter 100 provided in the present disclosure may be formed through the above-mentioned electrical connection method. The difference between the two structures of the inverter 100 may only be in the first module. For example, the leakage control component 10 in the first module may be the fourth transistor T4, or the leakage current control component 10 may be the second level signal input terminal VG2. The two inverters 100 provided in the present disclosure may all have the effect of reducing the leakage current of the first transistor T1 and the second transistor T2. Accordingly, the situation that the potentials of the first node N1 and the second node N2 rise may be avoided, the problem of the potential rise at the signal output terminal OutEnd may be avoided. Thus, it may facilitate to ensure that the pixel unit electrically connected to the inverter 100 is in a stable light-emitting state; and the display effect of the display product using the inverter 100 may be improved.

Further, referring to FIGS. 3-5, in one embodiment, the fifth transistor T5, the sixth transistor T6, the seventh transistor T7, the eighth transistor T8, and the ninth transistor T9 may all be P-type transistors. The third level signal input terminal VG3 may input a third level signal. The third level signal is a constant second type of level signal.

For example, when the leakage control component 10 in the first module is the fourth transistor T4, and the first transistor T1, the second transistor T2, the third transistor T3 and the fourth transistor T4 are all P-type transistors, the transistors in the second module may also all be P-type transistors, for example, the fifth transistor T5, the sixth transistor T6, the seventh transistor T7, the eighth transistor T8, and the ninth transistor T9 may all be P-type transistors. Under such a configuration, the inverter 100 in the present disclosure may all use single-channel type of transistors, e.g., all P-type thin-film transistors. The use of uniform type of thin-film transistors may reduce the complexity of the preparation process and production cost of the inverter 100, and the quality of products using the inverter 100 may be improved.

When the leakage current control component 10 in the first module is the second level signal input terminal VG2, on the basis of that the first transistor T1, the second transistor T2 and the third transistor T3 are all P-type transistors, the fifth transistor T5, the sixth transistor T6, the seventh transistor T7, the eighth transistor T8, and the ninth transistor T9 in the second module may also all be P-type transistors. Such a configuration may also achieve the effect of reducing the complexity and production cost of the preparation process of the inverter 100, and improving the quality of products using the inverter 100.

Based on the foregoing that each transistor in the inverter 100 is a P-type transistor, and the first level signal and the second level signal transmitted to the inverter 100 by the first level signal input terminal VG1 and the second level signal input terminal VG2 are all the first type of level signals (e.g., high-level signals), and the third level signal transmitted to the inverter 100 by the third level signal input terminal VG3 may be the second type of level signal. For example, the third level signal is a constant low-level signal.

Because the P-type transistors may have the characteristics of strong noise suppression, simple manufacturing process, low price, and good stability, etc., in this present disclosure, the transistors in inverter 100 may be all P-type transistors; and the transistors in inverter 100 may all be single-channel type of P-type transistors. Such a configuration may be beneficial to reduce the complexity of the preparation process and the production cost of the inverter 100, and at the same time, the product quality may be improved.

The previous description only uses the configurations that the transistors in the inverter 100 are all P-type transistors as examples, but the present disclosure does not specifically limit this, and those skilled in the art can easily refer to the examples that the P-type transistors in the inverter 100 are all changed to N-type transistors.

Figure 6:
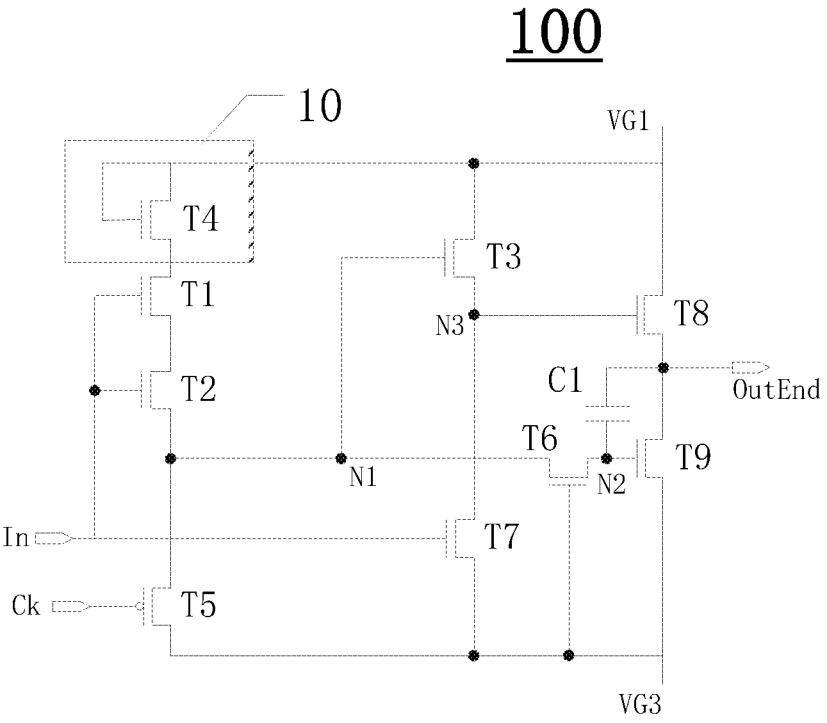
FIG. 6 illustrates another partial circuit diagram of an exemplary inverter consistent with various disclosed embodiments of the present disclosure.
Figure 7:
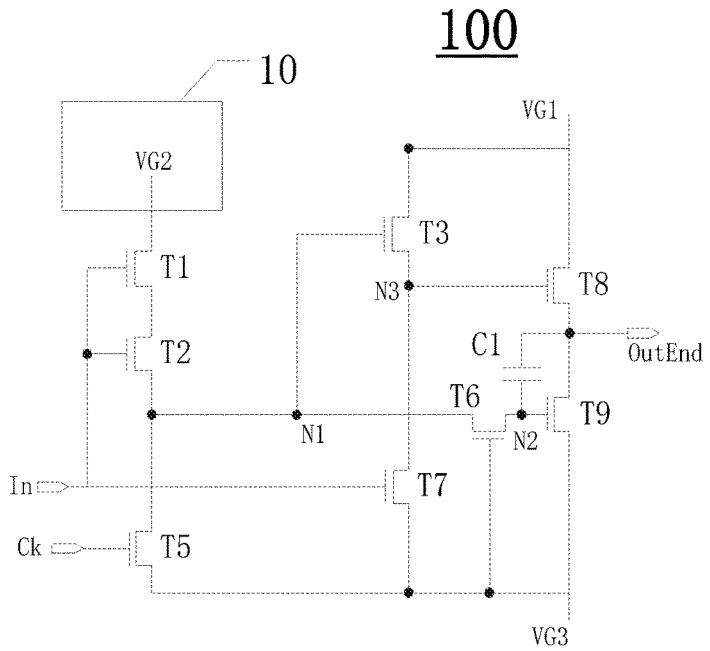
FIG. 7 illustrates another partial circuit diagram of an exemplary inverter consistent with various disclosed embodiments of the present disclosure.

FIG. 6 is a schematic diagram of another partial circuit diagram of an exemplary inverter consistent with various disclosed embodiments of the present disclosure, and FIG. 7 is a schematic diagram of another partial circuit diagram of an exemplary inverter consistent with various disclosed embodiments of the present disclosure.

As shown in FIGS. 6-7, in some embodiments, the first transistor T1, the second transistor T2, the third transistor T3, the fifth transistor T5, the sixth transistor T6, the seventh transistor T7, the eighth transistor T8, and the ninth transistor T1 in the inverter 100 may all be N-type transistors. When the leakage current control component 10 in the inverter 100 is the fourth transistor T4, the fourth transistor T4 may also be set to an N-type transistor. In addition, it may be necessary to adjust the level signal of each signal input terminal of the inverter 100. For example, the first level signal input terminal VG1 may input the first level signal, the second level signal input terminal VG2 may input the second level signal, and the third level signal input terminal VG3 may inputs the third-level signal. The first level signal and the second level signal may both be a constant second type of signals, and the third level signal may be a constant first type of level signal. For example, when the transistors in the inverter 100 are all N-type transistors, the electrical signals transmitted to the inverter 100 by the first level signal input terminal VG1 and the second level signal input terminal VG2 may be adjusted to be low-level signals and the electrical signal transmitted to the inverter 100 by the third-level signal input terminal VG3 may be adjusted to be a high-level signal to ensure the normal operation of the inverter 100.

Referring to FIGS. 6-7, in one embodiment, the first level signal is smaller than the second level signal.

For example, when the transistors in the inverter 100 provided in the present disclosure are all N-type transistors, and when the leakage current control component 10 is the second level signal input terminal VG2, the first level signal and the second level signal may be all low-level signals. At this time, it may be necessary to set the first level signal to be smaller than the second level signal. For example, the low-level signal transmitted to the inverter 100 by the first-level signal input terminal VG1 may be V3, the low-level signal transmitted to the inverter 100 by the second-level signal input terminal VG2 may be V4, and V3<V4. Such a configuration may make the first transistor T1 and the second transistor T2 at the off state, and the off state may be more complete. Thus, the leakage current transmitted to the first node N1 through the first transistor T1 and the second transistor T2 may be reduced, and the potential rise at the first node N1 may be prevented. Accordingly, the potential of the first node N1 may be maintained at a stable state; and the electrical signal output to the pixel unit through the inverter 100 may have a stable potential. Thus, the pixel unit driven by the inverter 100 may not have the problem of brightness change, and the phenomenon of flickering in the display device may be avoided.

Figure 8:
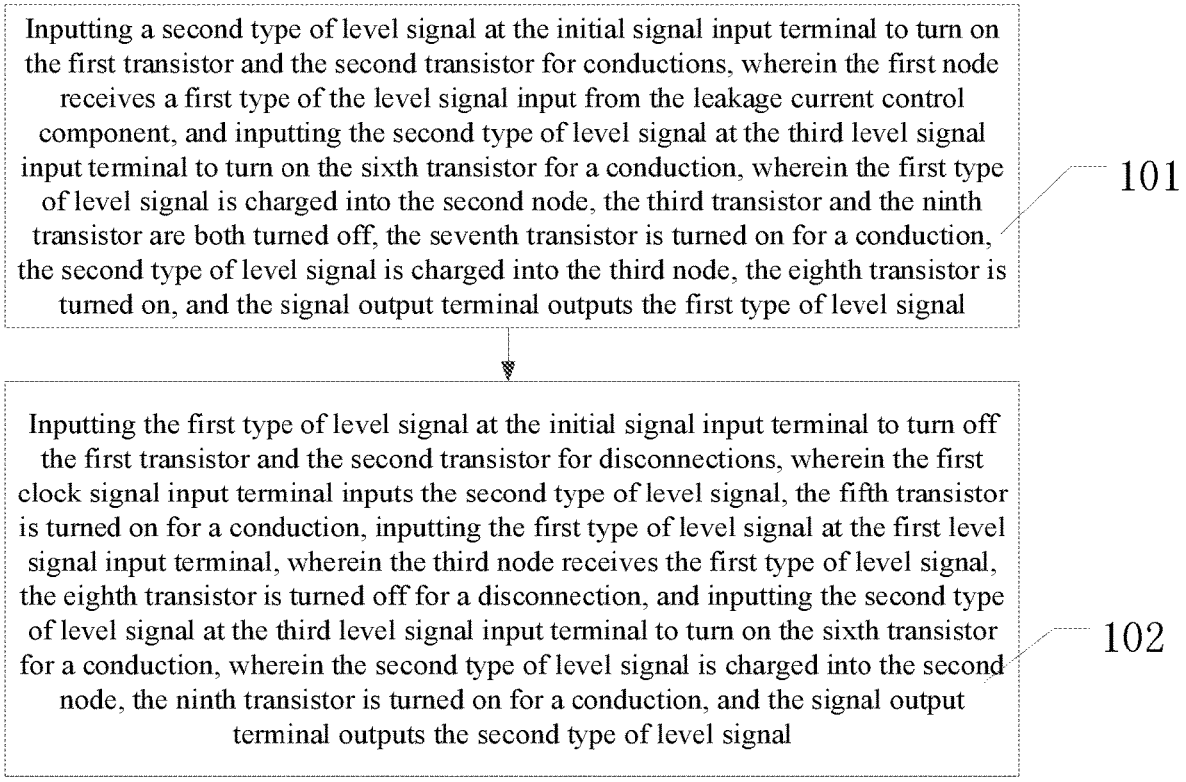
FIG. 8 illustrates an exemplary driving method corresponding to FIG. 3 consistent with various disclosed embodiments of the present disclosure.

The present disclosure also provides a method for driving an inverter. FIG. 8 is a flowchart of an exemplary driving method corresponding to FIG. 3 consistent with various disclosed embodiments of the present disclosure. The driving method may be used to drive the inverter 100 based on P-type transistors as shown in FIG. 3. The inverter 100 may include the first transistor T1, the second transistor T2, the third transistor T3, the fifth transistor T5, the sixth transistor T6, the seventh transistor T7, the eighth transistor T8, the ninth transistor T9, the leakage current control component 10, the initial signal input terminal In, the first level signal input terminal VG1, the first clock signal input terminal Ck, the third level signal input terminal VG3, and the signal Output terminal OutEnd.

As shown in FIG. 8, the driving method may include:

Step 101: inputting a second type of level signal in the initial signal input terminal In. The first transistor T1 and the second transistor T2 may be turned on for conductions, the first node N1 may receive the first type of level signal input through the leakage current control component 10. The third level signal input terminal VG3 may input the second type of level signal, the sixth transistor T6 may be turned on for a conduction, and the first type of level signal may be charged to the second node N2. The third transistor T3 and the ninth transistor T9 may be both turned off for disconnections, the seventh transistor T7 may be turned on for a conduction, the second type of level signal may be charged into the third node N3, the eighth transistor T8 may be turned on for a conduction, and the signal output terminal OutEnd may output the first type of level signal; and Step 102: inputting a first type of level signal to the initial signal input terminal In. The first transistor T1 and the second transistor T2 may be turned off for disconnections, the first clock signal input terminal Ck may input the second type of level signal, and the fifth transistor T5 may be turned on for a conduction. The second type of level signal may be charged into the first node N1, and the third transistor T3 may be turned on for a conduction. The first level signal input terminal VG1 may input the first type of level signal, the third node N3 may receive the first type of level signal, and the eighth transistor T8 may be turned off form a disconnection. The third level signal input terminal VG3 may input the second type of level signal, and the sixth transistor T6 may be turned on for a conduction. The second type of level signal may be charged to the second node N2, the ninth transistor T9 may be turned on for a conduction, and the signal output terminal OutEnd may output the second type of level signal.

Specifically, in the present disclosure, the configuration that the transistors in the inverter 100 are all P-type transistors is used as an example to describe the driving method of the inverter 100.

The driving method may include step 101: inputting a low-level signal (the second type of level signal) in the initial signal input terminal In. Because the transistors in the inverter 100 may be all P-type transistors, the P-type transistors may be turned on for a conduction at a low level. Thus, the first transistor T1 and the second transistor T2 may both be turned on for conductions, and the first node N1 may receive the high-level signal (the first type of level signal) input through the leakage control component 10, that is, the first node N1 may be charged with a high-level signal. The third level signal input terminal VG3 may input a low-level signal (the second type of level signal), the sixth transistor T6 may be turned on for a conduction, and the first type of level signal input in the first node N1 may then be charged in the second node N2. The control terminal of the third transistor T3 may be electrically connected to the first node N1, and the control terminal of the ninth transistor T9 may be electrically connected to the second node N2. The high-level signal may be unable to drive the transistor to turn on for a conduction, thus the third transistor T3 and the ninth transistor T9 may all be at the off state. Because the initial signal input terminal In may input a low-level signal (the second type of level signal), the seventh transistor T7 may be at the on state, and the low-level signal (the second type of level signal) input by the third level signal input terminal VG3 may be charged into the third node N3, the low-level signal of the third node N3 may drive the eighth transistor T8 to turn on, and the signal output terminal OutEnd may output the high-level signal (the first type of level signal) input from the first level signal input terminal VG1. For example, the initial signal input terminal In of the inverter 100 may input the low-level signal (the second type of level signal), and the signal output terminal OutEnd may output a high-level signal (the first type of level signal).

The driving method may further include step 102: inputting a high-level signal (the first type of level signal) at the initial signal input terminal In. Because the transistors in the inverter 100 may be all P-type transistors, and the P-type transistors may be turned on for conductions at the low-level, the first transistor T1 and the second transistor T2 may be both at the off state, and the first clock signal input terminal Ck may input a low-level signal (the second type of level signal) to drive the fifth transistor T5 to be turned on for a conduction, and the third low-level signal (the second type of level signal) input from the level signal input terminal VG3 may be charged into the first node N1, and the low-level signal at the first node N1 may drive the third transistor T3 to be turned on for a conduction. The high-level signal (the first type of level signal) input from the first level signal input terminal VG1 may be charged into the third node N3 through the third transistor T3, and the eighth transistor T8 may be at the off state. For example, the high-level signal (the first type of level signal) input from the signal input terminal VG1 may not be transmitted to the signal output terminal OutEnd through the eighth transistor T8. The third level signal input terminal VG3 may input a low-level signal (the second type of level signal), the sixth transistor T6 may be driven to turn on for a conduction. At this time, the low-level signal (the second-type level signal) pre-charged to the first node N1 may be then charged into the second node N2, and the low-level signal may drive the ninth transistor T9 to be turned on for a conduction. At this time, the low-level signal input from the third-level signal input terminal VG3 may be output from the signal output terminal OutEnd after passing through the ninth transistor T9. For example, at this time, the signal output terminal OutEnd may output a low-level signal (the second type of level signal). That is, the initial signal input terminal In of the inverter 100 may input a high-level signal (the first type of level signal), and the signal output terminal OutEnd may output a low-level signal (the second type of level signal).

It should be noted that the inverter 100 may also include a first capacitor C1. The first plate of the first capacitor C1 may be electrically connected to the second node N2, and the second plate of the first capacitor may be electrically connected to the signal output terminal OutEnd. The first capacitor C1 may be able to pull down the potential of the second node N2 lower to avoid the problem of threshold loss when the low-level signal input from the third-level signal input terminal VG3 passes through the ninth transistor T9.

Further, referring to FIG. 4, in one embodiment, the leakage current control component 10 may include a fourth transistor T4. The control terminal of the fourth transistor T4 may be electrically connected to the first terminal of the fourth transistor T4, and the first terminal of the fourth transistor T4 may be electrically connected to the first terminal of the fourth transistor T4. Further, the first terminal of the fourth transistor T4 may be electrically connected to the level signal input terminal VG1, and the second terminal of the fourth transistor T4 may be electrically connected to the second terminal of the first transistor T1.

The driving method of the inverter 100 may further include that the initial signal input terminal In may input a second type of level signal. The first transistor T1, the second transistor T2, and the fourth transistor T4 may be turned on for conductions, and the first level signal input terminal VG1 may input the first level signal to the first node N1.

For example, when the leakage control component 10 is the fourth transistor T4, the first level signal input from the first level signal input terminal VG1 may be a high-level signal, and when the initial signal input terminal In inputs a low-level signal (the second type of level signal), the connection between the first terminal and the second terminal of the fourth transistor T4 may be explained as following. The voltage at the first terminal of the ninth transistor T9 is greater than the voltage at the second terminal, and the fourth transistor T4 may be equivalent as a diode. Under such a condition, due to the voltage difference between the first terminal and the second terminal, the fourth transistor T4 may be turned on for a conduction. Further, at this time, the first transistor T1 and the second transistor T2 may both be at the open state. Thus, the first level signal input from the signal input terminal VG1 may be charged to the first node N1.

The fourth transistor T4 provided in the present disclosure may be an indium gallium zinc oxide thin-film transistor (IGZO TFT). Because the IGZO TFT may have the characteristics of low cost and low leakage current, the fourth transistor T4 with the characteristics of low leakage current may be disposed in the inverter 100 to reduce the overall leakage current in the inverter 100. For example, the leakage current passing through the first transistor T1 and the second transistor T2 may be reduced to prevent the leakage current from being transmitted to the first node N1 and the second node N2. Thus, the potential of the first node N1 and the second node N2 may be prevented from rising, and the electrical signal output to the pixel unit by the inverter 100 may have a stable potential. Accordingly, the pixel unit driven by the inverter 100 may not have the problem of brightness change, and the phenomenon of flickering in the display device may be avoided.

Referring to FIG. 5, in one embodiment, the leakage current control component 10 may include a second level signal input terminal VG2. The second level signal input terminal VG2 may be electrically connected to the first level signal input terminal VG1.

The driving method of the inverter 100 may further include that the initial signal input terminal In inputs a second level signal, the first transistor T1 and the second transistor T2 may be turned on for conductions, and the second level signal input terminal VG2 may input the second level signal to the first node N1.

For example, when the leakage current control component 10 is the second level signal input terminal VG2, the second level signal input by the second level signal input terminal VG2 may be a high-level signal; at this time, the first transistor T1 and the second transistor T2 may all be at an open state. Thus, the first level signal input from the first level signal input terminal VG1 may be charged to the first node N1.

In the present disclosure, the second level signal may be set to be smaller than the first level signal, even if the threshold voltage Vth of the first transistor T1 and the second transistor T2 increases during the working process, by pulling down the potential of the driving signal transmitted to them, e.g., pulling down the potential of the second level signal at the second level signal input terminal VG2, the effect of turning off the first transistor T1 and the second transistor T2 may still be achieved, and also a completely turning off may be achieved. Thus, the leakage current transmitted by the transistor T1 and the second transistor T2 to the first node N1 and the second node N2 may be reduced; and the situation that the potential of the first node N1 and the second node N2 rises may be avoided. Accordingly, the electrical signal output to the pixel unit by the inverter 100 may have a stable potential, and the pixel unit driven by the inverter 100 may not have the problem of brightness changes, and the flickering phenomenon of the display device may be avoided.

Figure 9:
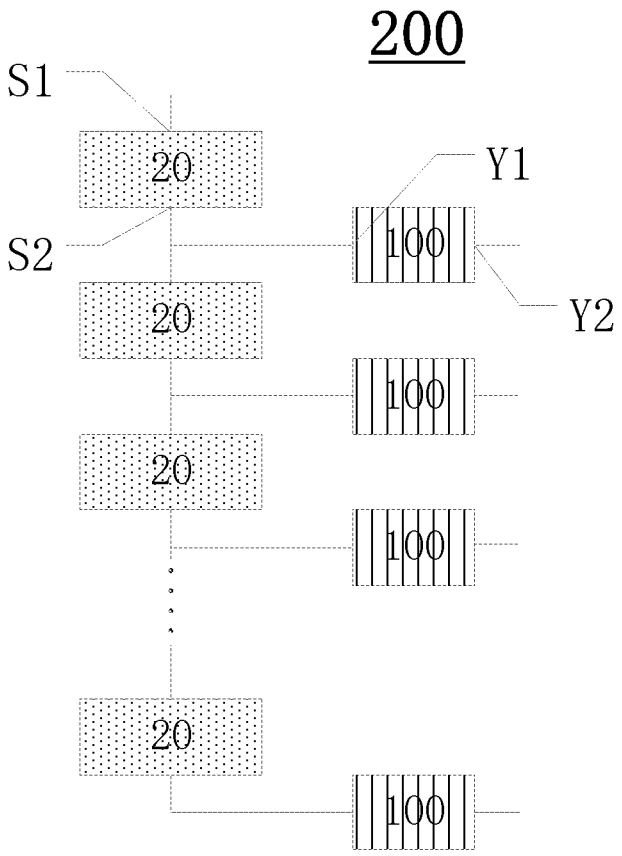
FIG. 9 illustrates an exemplary driving circuit including an inverter consistent with various disclosed embodiments of the present disclosure.

Further, the present disclosure provides a driving circuit. FIG. 9 is a schematic diagram of an exemplary driving circuit including an inverter consistent with various disclosed embodiments of the present disclosure.

As shown in FIG. 9 and referring to FIGS. 3-5, the driving circuit 200 may include an inverter 100. The driving circuit 200 may include N levels of shift registers 20 and N inverters 100. N is an integer greater than 1. The N levels of shift register 20 may include a first level shift register 20 to an N-th level shift register 20. The N inverters 100 may include a first inverter 100 to an N-th inverter 100. Each level of shift register 20 may have one input terminal S1 and one output terminal S2. Each inverter 100 may have one input terminal Y1 and one output terminal Y2. The input terminal S1 of the shift register 20 of the first level may be used as the input terminal of the driving circuit 200, and the inverter 100 has an input terminal Y1 and an output terminal Y2. From the second level shift register 20, the input terminal S1 of each level shift register 20 may be electrically connected to the output terminal S2 of the previous level shift register 20, and the output terminals S2, of every number i of shift registers 20 may be electrically connected to the input terminal Y1*i* of the i-th inverter 100. $1 \leq i \leq N$. The output terminal Y2 of each inverter 100 may used as the corresponding output terminal of the drive circuit 200. Each inverter 100 may invert the output signal of the shift register 20 electrically connected to it and configure the obtained inverted signal as the output signal of the driving circuit 200.

The driving circuit 200 provided by the embodiment of the present disclosure may use an inverter 100 with a stable output signal. Thus, the driving circuit 200 may be able to output a stable output signal.

Figure 10:
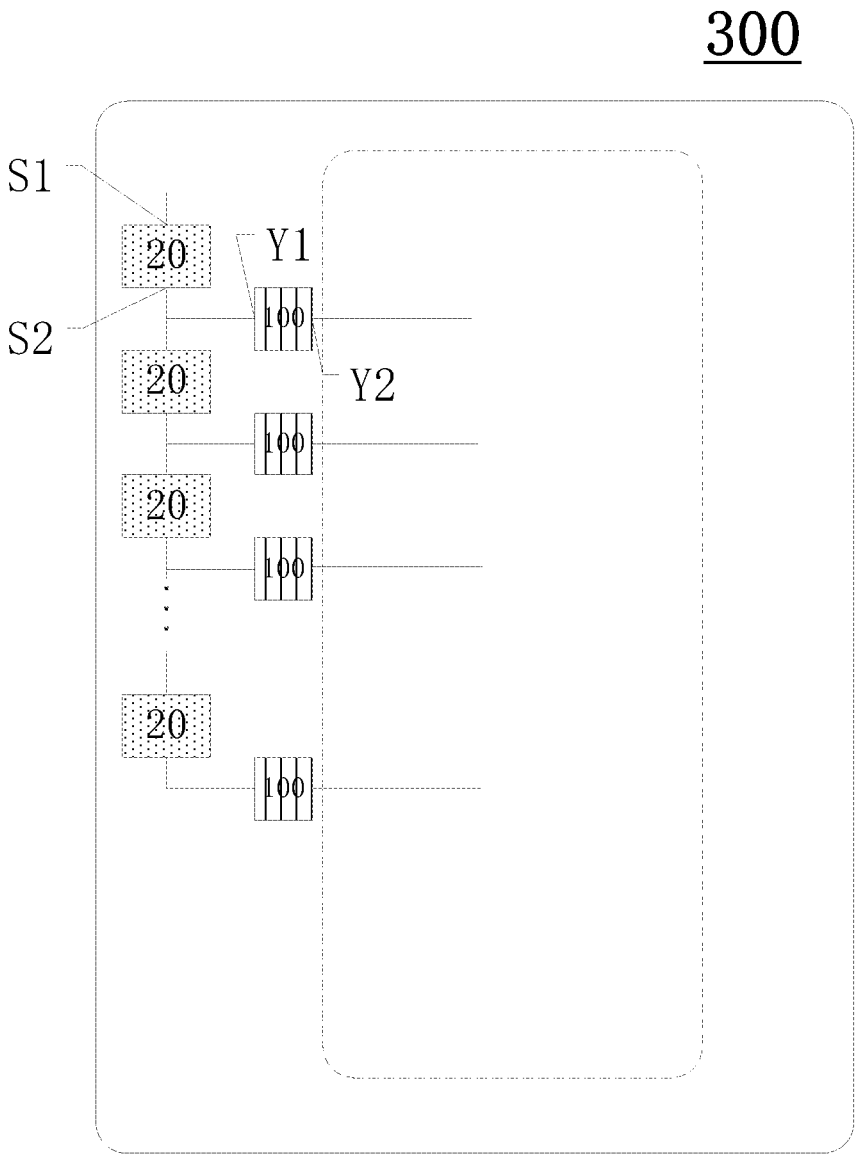
FIG. 10 illustrates an exemplary display panel consistent with various disclosed embodiments of the present disclosure.

Further, the present disclosure provides a display panel. FIG. 10 is a schematic diagram of an exemplary display panel consistent with various disclosed embodiments of the present disclosure.

As shown in FIG. 10, the display panel 300 provided in the present disclosure may include the present disclosed driving circuit 200. By adopting the driving circuit 200 capable of outputting stable signals in the array substrate of the display panel 300, the pixel units in the display panel 300 may work stably. Thus, the corresponding display panel 300 may achieve better display effects.

Figure 11:
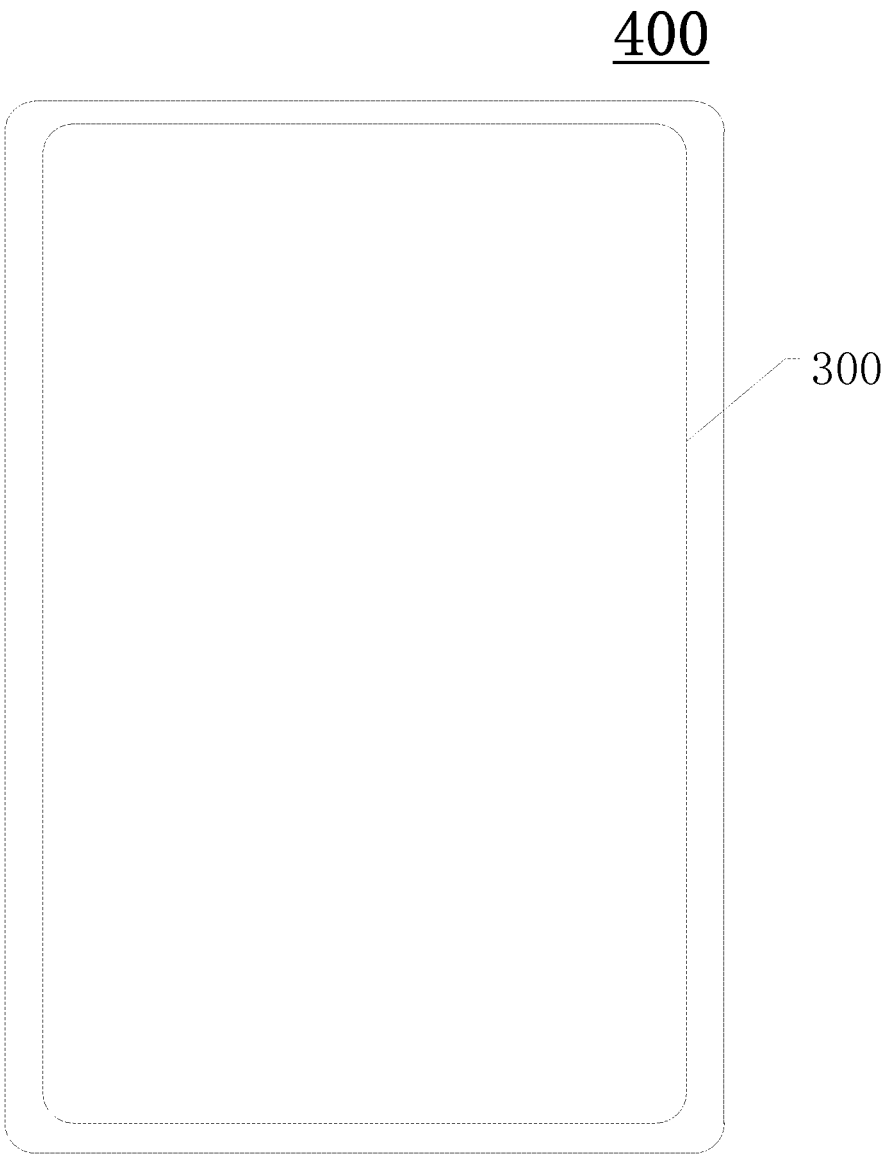
FIG. 11 illustrates an exemplary display device consistent with various disclosed embodiments of the present disclosure.

Further, the present disclosure provides a display device. FIG. 11 is a schematic diagram of an exemplary display device consistent with various disclosed embodiments of the present disclosure.

As shown in FIG. 11, the display device 400 provided in the present disclosure may include a display panel 300. The display panel 300 may be a present disclosed display panel 300 including a driving circuit 200 capable of outputting a stable signal. Thus, the corresponding display device may achieve better display effects.

It should be noted that, for the embodiments of the display device provided in the embodiments of the present application, reference may be made to the embodiments of the above-mentioned display panel. The display device provided by the present disclosure may be any product and component with a display function, such as a mobile phone, a tablet computer, a TV, a monitor, a notebook computer, a car display, or a navigator, etc.

It can be known from the foregoing embodiments that the inverter, its driving method, the driving circuit, and the display panel provided by the present invention may at least achieve the following beneficial effects:

The present disclosure provides an inverter and a driving method of the inverter, a driving circuit and a display panel. A leakage current control component may be added to the inverter to reduce the overall leakage current of the inverter such that the potential of each node inside the inverter may be at a stable state to prevent the potential of each node from being raised, thereby ensuring that the inverter may output a stable control signal. Thus, the display effect of the display product using the inverter may be enhanced.

Although some specific embodiments of the present invention have been described in detail through examples, those skilled in the art should understand that the above examples are only for illustration and not for limiting the scope of the present disclosure. Those skilled in the art should understand that the above embodiments can be modified without departing from the scope and spirit of the present disclosure. The scope of the disclosure is defined by the appended claims.

What is claimed is:

1. An inverter, comprising:

a first module;

a second module;

an initial signal input terminal; and a first level signal input terminal, wherein:

the first module includes a first transistor, a second transistor, and a third transistor;

a control terminal of the first transistor and a control terminal of the second transistor are both electrically connected to the initial signal input terminal;

a first terminal of the third transistor is electrically connected to the first level signal input terminal;

a first terminal of the second transistor is electrically connected to a first terminal of the second transistor;

a second terminal of the second transistor is electrically connected to a control terminal of the third transistor through a first node;

the first module includes a leakage current control component; and the leakage current control component is at least electrically connected with the second terminal of the first transistor.

2. The inverter according to claim 1, wherein the leakage current control component comprises:

a fourth transistor, wherein a control terminal of the fourth transistor is electrically connected to a first terminal of the fourth transistor and the first terminal of the fourth transistor is electrically connected to the first level signal input terminal, and a second terminal of the fourth transistor is electrically connected to the second terminal of the first transistor.

3. The inverter according to claim 2, wherein:

the fourth transistor is an indium gallium zinc oxide thin-film transistor.

4. The inverter according to claim 1, wherein the leakage current control component comprises:

a second level signal input terminal, wherein the second level signal input terminal is electrically connected to the second terminal of the first transistor.

5. The inverter according to claim 4, wherein:

the first transistor, the second transistor and the third transistor are all P type transistors;

the first level signal input terminal inputs a first level signal;

the second level signal input terminal inputs a second level signal; and each of the first level signal and the second level signal is a first type of level signal and is a constant signal.

6. The inverter according to claim 5, wherein:

the second level signal is smaller than the first level signal.

7. The inverter according to claim 1, wherein the second module comprises:

a fifth transistor;

a sixth transistor;

a seventh transistor;

an eighth transistor;

a ninth transistor;

a first capacitor;

a first clock signal input terminal;

a third level signal input terminal; and a signal output terminal, wherein:

a control terminal of the fifth transistor is electrically connected to the first clock signal input terminal, a first terminal of the fifth transistor is electrically connected to the first node, and a second terminal of the fifth transistor is electrically connected to the third level signal input terminal;

a control terminal of the sixth transistor is electrically connected to the third level signal input terminal, a first terminal of the sixth transistor is electrically connected to the first node, and a second terminal of the sixth transistor is electrically connected to a control terminal of the ninth transistor;

a control terminal of the seventh transistor is electrically connected to the initial signal input terminal, a first terminal of the seventh transistor is electrically connected to a second terminal of the third transistor through a third node, and a second terminal of the seventh transistor is electrically connected to the third level signal input terminal;

a control terminal of the eighth transistor is electrically connected to the third node, a first terminal of the eighth transistor is electrically connected to the first level signal input terminal, and a second terminal of the eighth transistor is electrically connected to the signal output terminal;

a control terminal of the ninth transistor is electrically connected to the signal output terminal, and a second terminal of the ninth transistor is electrically connected to the third level signal input terminal; and a first plate of the first capacitor is electrically connected to the second node, and a second plate of the first capacitor is electrically connected to the signal output terminal.

8. The inverter according to claim 7, wherein:

the fifth transistor, the sixth transistor, the seventh transistor, the eighth transistor and the ninth transistor are all P-type transistors;

the third level signal input terminal inputs a third level signal; and the third level signal is a second type of level signal and a constant signal.

9. The inverter according to claim 7, wherein:

the first transistor, the second transistor, the third transistor, the fifth transistor, the sixth transistor, the seventh transistor, the eighth transistor and the ninth transistor are all N-type transistors;

the first level signal input terminal inputs a first level signal;

the second level signal input terminal inputs a second level signal;

the third level signal input terminal inputs a third level signal;

each of the first level signal and the second level signal is a second type of level signal and a constant signal; and the third level signal is a first type of level signal and a constant signal.

10. The inverter according to claim 9, wherein:

the first level signal is smaller than the second level signal.

11. A method for driving an inverter, wherein the inverter includes a first transistor, a second transistor, a third transistor, a fifth transistor, a sixth transistor, a seventh transistor, an eighth transistor, a ninth transistor, a leakage current control component, an initial signal input terminal, a first level signal input terminal, a first clock signal input terminal, a third level signal input terminal, a signal output terminal, a first node, a second node and a third node, comprising:

inputting a second type of level signal at the initial signal input terminal to turn on for conductions of the first transistor and the second transistor, wherein the first node receives a first type of the level signal input from the leakage current control component, and inputting the second type of level signal at the third level signal input terminal to turn on for a conduction of the sixth transistor, wherein the first type of level signal is charged into the second node, the third transistor and the ninth transistor are both turned off for disconnections, the seventh transistor is turned on for a conduction, the second type of level signal is charged into the third node, the eighth transistor is turned on for a conduction, and the signal output terminal outputs the first type of level signal; and inputting the first type of level signal at the initial signal input terminal to turn off for disconnections of the first transistor and the second transistor, wherein the first clock signal input terminal inputs the second type of level signal, the fifth transistor is turned on for a conduction, inputting the first type of level signal at the first level signal input terminal, wherein the third node receives the first type of level signal, the eighth transistor is turned off for a disconnection, and inputting the second type of level signal at the third level signal input terminal to turn on for a conduction of the sixth transistor, wherein the second type of level signal is charged into the second node, the ninth transistor is turned on for a conduction, and the signal output terminal outputs the second type of level signal.

12. The method according to claim 11, wherein:

the leakage current control component includes a fourth transistor, a control terminal of the fourth transistor is electrically connected to a first terminal of the fourth transistor, the first terminal of the fourth transistor is connected to the first level signal input terminal, and a second terminal of the fourth transistor is electrically connected to a second terminal of the first transistor; and the method for driving the inverter further includes inputting the second type of level signal at the initial signal input terminal to turn on for conductions of the first transistor, the second transistor and the fourth transistor, wherein the first level signal input terminal inputs the first level signal to the first node.

13. The method according to claim 11, wherein:

the leakage current control component includes a second level signal input terminal electrically connected to the first level signal input terminal; and the method for driving the inverter further includes inputting the second type of level signal at the initial signal input terminal to turn on for conductions of the first transistor and the second transistor, wherein the second level signal input terminal inputs the second level signal to the first node.

14. A driving circuit, comprising:

an inverter, wherein the inverter includes:

a first module;

a second module;

an initial signal input terminal; and a first level signal input terminal, wherein:

the first module includes a first transistor, a second transistor and a third transistor;

a control terminal of the first transistor and a control terminal of the second transistor are both electrically connected to the initial signal input terminal;

a first terminal of the third transistor is electrically connected to the first level signal input terminal;

a first terminal of the second transistor is electrically connected to a first terminal of the second transistor;

a second terminal of the second transistor is electrically connected to a control terminal of the third transistor through a first node;

the first module includes a leakage current control component; and the leakage current control component is at least electrically connected with the second terminal of the first transistor.

15. A display panel, comprising the driving circuit according to claim 14.

* * * * *